United States Patent [19]

Malec

[11] 4,374,033

[45] Feb. 15, 1983

[54] DISPERSANT AND LUBRICATING OIL CONTAINING THE DISPERSANT

[75] Inventor: Robert E. Malec, Ladue, Mo.

[73] Assignee: Edwin Cooper, Inc., St. Louis, Mo.

[21] Appl. No.: 274,827

[22] Filed: Jun. 18, 1981

[51] Int. Cl.[3] ..... C10M 1/20; C10M 1/32; C10M 1/54

[52] U.S. Cl. ..... 252/49.6; 568/1

[58] Field of Search ..... 252/49.6; 568/1

[56] References Cited

U.S. PATENT DOCUMENTS 3,254,025 5/1966 LeSuer ..... 252/49.6 X 4,173,540 10/1977 Lonstrup et al. ..... 252/49.6

FOREIGN PATENT DOCUMENTS 1054370 1/1967 United Kingdom .

*Primary Examiner*—W. J. Shine

*Attorney, Agent, or Firm*—Donald L. Johnson; John F. Sieberth; Joseph D. Odenweller

[57] ABSTRACT

Lubricating oil properties are improved by the addition of the reaction product of an aliphatic hydrocarbon substituted succinic anhydride, an amino pyrrolidone and a boronating agent.

16 Claims, No Drawings

DISPERSANT AND LUBRICATING OIL CONTAINING THE DISPERSANT

BACKGROUND OF THE INVENTION

Lubricating oil containing ashless dispersants made from alkenyl succinic anhydride and ethylene polyamines are known (U.S. Pat. No. 3,272,746). Boranated alkenyl succinimides are also known (U.S. Pat. No. 3,254,025). Succinic ashless dispersants have also been made by reacting an alkenyl succinic anhydride with an N-aminoakyl pyrrolidone (G.B. No. 1,054,370).

SUMMARY

According to the present invention, new lubricating oil dispersants are provided which are very effective in inhibiting engine varnish and sludge. These new dispersants are made by reacting an ethylene polyamine with butyrolactone to form an amino pyrrolidone intermediate and reacting this intermediate with an aliphatic hydrocarbon-substituted succinic acid, anhydride or ester thereof and a boronating agent.

DESCRIPTION OF THE PREFERRED EMBODIMENTS

A preferred embodiment of the invention is a dispersant suitable for use in lubricating oil made by a process comprising reacting (a) an amino pyrrolidone intermediate made by reacting about 0.5–2.5 moles of butyrolactone with about 1 mole of an ethylene polyamine, (b) about 1–3 moles of an aliphatic hydrocarbon-substituted succinic anhydride, acid or lower alkyl ester thereof wherein said hydrocarbon substituent has a molecular weight of about 700–100,000 and (c) a boronating agent in an amount sufficient to impart about 0.01–1.5 weight percent boron into the final product.

Ethylene polyamines useful in the invention have the formula $$H_2N-(CH_2CH_2NH)_nH$$

wherein n is an integer from 1 to about 6. Examples of these are ethylenediamine, diethylenetriamine, triethylenetetramine, tetraethylenepentamine and the like, including mixtures thereof. Commercial ethylene polyamines are usually mixtures and contain other components in small amounts such as N-(2-aminoethyl)piperazine, a heterocyclic ethylene polyamine formed in the manufacture of ethylene polyamines and included in the generic term "ethylene polyamines".

Aliphatic hydrocarbon-substituted succinic acids, anhydrides or lower alkyl esters thereof are well-known compounds. They can be made by reacting an olefin or aliphatic hydrocarbyl halide with maleic anhydride which can then be hydrolyzed or esterified by conventional procedures if desired. The preferred method for making the preferred aliphatic hydrocarbon-substituted succinic anhydride is to react an α-olefin of the desired molecular weight and maleic anhydride. This reaction can be catalyzed by peroxides or by injecting a halogen such as chlorine.

Preferred α-olefin reactants are branched chain olefin polymers having a molecular weight of about 700–100,000 such as polypropylene, polybutene, ethylene-propylene copolymer, ethylene/propylene/nonconjugated diene (e.g. dicyclopentadiene) terpolymer and the like.

The more preferred aliphatic hydrocarbon substituent is formed by reacting butene polymer having a molecular weight of about 700–100,000 with maleic anhydride to form a polybutenyl succinic anhydride. Highly preferred butene polymer substituents have an average molecular weight of about 700–10,000 and most preferably about 700–2000.

Such aliphatic hydrocarbon substituted succinic anhydrides have the formula

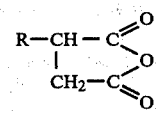

wherein R is an aliphatic hydrocarbon group having a molecular weight of about 700–100,000, more preferably 700–10,000 and most preferably 700–2000.

The aliphatic hydrocarbon-substituted succinic anhydride may be hydrolyzed or used in its acid form although this is not preferred. Likewise, it may be converted to a lower alkyl acid-ester or diester by reaction with a lower alkanol such as methanol, ethanol, *n*-propanol, isopropanol, *n*-butanol, isobutanol, and the like.

Boronating agents useful in making the products include boron compounds which will react in the process to introduce boron into the reaction components formed from the ethylene polyamine, butyrolactone and aliphatic hydrocarbon-substituted succinic acid, anhydride or lower alkyl ester thereof. This includes boron compounds such as boron oxide, boron oxide hydrate, boron trifluoride, boron tribromide, boron trichloride, $HBF_4$, boron acids such as boronic acid (e.g. alkyl-$B(OH)_2$ or aryl-$B(OH)_2$, boric acid (i.e. $H_3BO_3$), tetraboric acid (i.e. $H_2B_4O_7$), metaboric acid (i.e. $HBO_2$), and esters of such boron acids. The use of complexes of a boron trihalide with ethers, organic acids, inorganic acids, or hydrocarbons is a convenient means of introducing the boron reactant into the reaction mixture. Such complexes are known and are exemplified by boron-trifluoride-diethyl ether, boron trifluoride-phenol, boron trifluoride-phosphoric acid, boron trichloride-chloroacetic acid, boron tribromide-dioxane, and boron trifluoride-methyl ethyl ether.

Specific examples of boronic acids include methyl boronic acid, phenyl-boronic acid, cyclohexyl boronic acid, *p*-heptylphenyl boronic acid and dodecyl boronic acid.

The boron acid esters include especially mono-, di-, and tri-organic esters of boric acid with alcohols or phenols such as, e.g. methanol, ethanol, isopropanol, cyclohexanol, cyclopentanol, 1-octanol, 2-octanol, dodecanol, behenyl alcohol, oleyl alcohol, stearyl alcohol, benzyl alcohol, 2-butyl cyclohexanol, ethylene glycol, propylene glycol, trimethylene glycol, 1,3-butanediol, 2,4-hexanediol, 1,2-cyclohexanediol, 1,3-octanediol, glycerol, pentaerythritol, diethylene glycol, carbitol, Cellosolve, triethylene glycol, tripropylene glycol, phenol, naphthol, *p*-butylphenol, *o,p*-diheptylphenol, *p*-cyclohexylphenol, 2,2-bis-(*p*-hydroxyphenyl)-propane, polyisobutene (molecular weight of 1500)-substituted phenol, ethylchlorohydrin, *o*-chlorophenol, *m*-nitrophenol, 6-bromooctanol, and 7-keto-decanol. Lower alcohols, 1,2-glycols and 1,3-glycols, i.e. those having less than about 8 carbon atoms are especially useful for preparing the boric acid esters for the purpose of this invention.

Methods for preparing the esters of boron acid are known and disclosed in the art (such as "Chemical Reviews", pages 959–1064, Vol. 56). Thus, one method involves the reaction of boron trichloride with 3 moles of an alcohol or a phenol to result in a tri-organic borate. Another method involves the direct esterification of tetra boric acid with 3 moles of an alcohol or a phenol. Still another method involves the direct esterification of boric acid with a glycol to form, e.g. a cyclic alkenylene borate.

Useful salts of boron acids include sodium metaborate, sodium tetraborate, potassium borate, hydrated sodium and potassium borates, ammonium borate, hydrated ammonium borate and the like.

The preferred boronating agent is boric acid, $H_3BO_3$.

The reaction products are made by initially reacting the ethylene polyamine with butyrolactone to form an amino pyrrolidone intermediate. This is readily accomplished by merely heating a mixture of the ethylene polyamine and butyrolactone to a reaction temperature high enough to cause a reaction to proceed to form pyrrolidone groups but not so high as to cause decomposition of the products. A useful temperature range is about 100°–300° C. and a more preferably temperature range is about 100°–200° C.

The ratio of reactants used in making the amino pyrrolidone intermediate is preferably about 0.5–2.5 moles of butyrolactone per mole of ethylene polyamine based on the average molecular weight of the ethylene polyamine. A more preferred ratio is about 1–2 moles of butyrolactone per mole of ethylene polyamine and a most preferred ratio is about 1 mole of butyrolactone per mole of ethylene polyamine.

The amino-pyrrolidone-forming reaction is preferably conducted in an inert water immiscible solvent such as hexane, heptane, nonane and the like. Aromatic hydrocarbons are most preferable such as benzene, toluene, xylene, and the like. When the reaction is carried out in such solvents, it is preferred to co-distill from the reaction mixture the solvent and water formed in the reaction. The solvent may be recycled to the reaction following well-known chemical procedures.

The amino pyrrolidone intermediate is then reacted with aliphatic hydrocarbon-substituted succinic anhydride acid or lower alkyl ester thereof and a boronating agent. These may be reacted altogether or in any sequence. For example, the boronating agent may initially be reacted with the amino pyrrolidone intermediate followed by reaction with the aliphatic hydrocarbon-substituted succinic compound. Likewise, the boronating agent may initially be reacted with the aliphatic hydrocarbon-substituted succinic compound followed by reaction with the amino pyrrolidone. Alternatively, the aliphatic hydrocarbon-substituted succinic compound may be initially reacted with amino pyrrolidone intermediate followed by reaction with the boronating agent. Also, all components including the aliphatic hydrocarbon-substituted succinic compound, the amino pyrrolidone intermediate, and the boronating agent may be combined and heated to reaction temperature to prepare the product in a single stage.

A preferred method of preparing the reaction product is to first react the amino pyrrolidone intermediate with the aliphatic hydrocarbon-substituted succinic compound to form an aliphatic hydrocarbon-substituted succinamide or succinimide of the amino pyrrolidone intermediate and then reacting this succinamide or succinimide with the boronating agent.

The mole ratio of the aliphatic hydrocarbon-substituted succinic compound to the amino pyrrolidone is about 1–3 to 1. For this calculation the number of moles of amino pyrrolidone intermediate is the same as the number of moles of ethylene polyamine used initially. A more preferred range is about 1.25–2 moles of substituted succinic compound per mole of amino pyrrolidone intermediate.

A preferred temperature range for the reaction of amino pyrrolidone intermediate with the aliphatic hydrocarbon substituted succinic compound is about 100°–300° C. A more preferred temperature range is about 150°–250° C.

The aliphatic hydrocarbon-substituted succinamide or succinimide of the amino pyrrolidone intermediate is boronated by adding the boronating agent to the succinamide or succinimide and heating the mixture to a temperature high enough to cause a boronation reaction but not high enough to destroy the product. A useful boronating temperature is about 100°–300° C., more preferably about 150°–250° C. When the preferred boronating agent boric acid is used, water is distilled out during the boronation. At the end of the boronation, vacuum can be applied to remove the last trace of water and any excess boronating agent filtered off.

The amount of boronating agent used should be enough to introduce about 0.01–1.5 weight percent boron into the reaction product excluding any diluents or solvents that might be present.

The following example illustrates methods for making the reaction products.

EXAMPLE 1

The Amino Pyrrolidone Intermediate

In a reaction vessel was placed 1080 grams of ethylene polyamine having an average molecular weight of 180. To this was added 500 ml. of toluene. This was heated to 184° C. and over a period of 2.25 hours, a total of 516.6 (6 moles) of butyrolactone was added while distilling out water. Reflux was continued at about 182° C. for 0.5 hour while removing water. A total of 111 grams (approx. 6 moles) of water was removed. The toluene was distilled out leaving an amino pyrrolidone intermediate analyzing 4.32 percent primary amine and 23.98 percent total nitrogen.

The Succinimide

In a reaction vessel was placed 228 grams (0.92 moles) of the above amino pyrrolidone intermediate and 1363 grams (1.2 moles) of butene polymer-substituted succinic anhydride. This was diluted with about 526 g. of No. 5 process oil. The stirred mixture was heated at 175° C. for 4.5 hours forming a polybutenyl succinimide of the amino pyrrolidone intermediate analyzing 1.09 weight percent amine nitrogen and 2.62 per cent total nitrogen.

The Boronation

In a reaction vessel was placed 1993 grams of the above succinimide product and 130 grams of boric acid ($H_3BO_3$). The stirred mixture was heated at 175° C. for 3 hours while distilling out water. During the last hour, vacuum was applied to assist in removing residual water. The product, after filtering, analyzed 0.45 weight percent boron and 2.54 weight percent nitrogen.

EXAMPLE 2

In a reaction vessel was placed 186 grams (0.75 moles) of the amino pyrrolidone intermediate prepared in Example 1. To this was added 1363 grams (1.2 moles) of a butene polymer-substituted succinic anhydride and 494 grams of No. 5 process oil. The stirred mixture was heated at 175° C. for 4 hours forming a polybutenyl succinimide of the amino pyrrolidone intermediate.

To the above product, 1975 grams was added 130 grams of boric acid. This mixture was stirred and heated to 175° C. while distilling out water. Vacuum was applied at the end of the heating. The residual product, after filtration, analyzed 0.45 weight percent boron.

EXAMPLE 3

An amino pyrrolidone intermediate was prepared by heating a mixture of 918 grams (5.1 moles) of an ethylene polyamine and 733.2 grams (8.52 moles) of butyrolactone and 350 ml. of toluene. The mixture was heated at 180°-190° C. over a 24 hour period while distilling out water. A total of 144 grams of water was removed. The product analyzed 21.73 weight percent nitrogen.

In a reaction vessel was placed 1363 grams (1.2 moles) of a butene polymer succinic anhydride and 146.3 grams (0.48 moles) of the above amino pyrrolidone intermediate. This was heated at 175° C. for 4.5 hours while distilling out water. Towards the end of the reaction, pressure was reduced to 200 mm. Hg. abs to assist in water removal. Then, 522 grams of No. 5 process oil was added.

In a reaction vessel was placed 1977 grams (1.37 moles) of the above succinimide product, and 127 grams of boric acid. The mixture was heated to 175° C. for 3 hours. During the last hour, vacuum was applied to assist in water removal. The product was filtered at 120° C. through a Buchner funnel containing a layer of diatomaceous earth. The product analyzed 1.48 weight percent nitrogen and 0.75 weight per cent boron.

The additives are added to lubricating oil in an amount which improves the dispersant properties of the oil. A useful concentration is about 0.5-10 weight percent. A more preferred range is about 1.0-7 weight percent exclusive of diluent oil.

The additives can be used in mineral oil or in synthetic oils of viscosity suitable for use in the crankcase of an internal combustion engine. Crankcase lubricating oils have a viscosity up to about 80 SUS at 210° F. Sometimes such motor oils are given a classification of both 0° and 210° F., such as SAE 10W 40 or SAE 5W 30.

Mineral oils include those of suitable viscosity refined from crude oil from all sources including Gulfcoast, midcontinent, Pennsylvania, California, Alaska, North Sea, and the like. Various standard refinery operations can be used in processing the mineral oil.

Synthetic oil includes both hydrocarbon synthetic oil and synthetic esters. Useful synthetic hydrocarbon oils include liquid polymers of α-olefins having the proper viscosity. Especially useful are the hydrogenated liquid oligomers of $C_{6-12}$ α-olefins such as α-decene trimer. Likewise, alkylbenzenes of proper viscosity can be used, such as didodecylbenzene.

Useful synthetic esters include the esters of both monocarboxylic acid and polycarboxylic acid as well as monohydroxy alkanols and polyols. Typical examples are didodecyl adipate, trimethylol propane tripelargonate, pentaerythritol tetracaproate, di-(2-ethylhexyl)adipate, dilauryl sebacate and the like. Complex esters prepared from mixtures of mono- and dicarboxylic acid and mono- and polyhydroxyl alkanols can also be used.

Blends of mineral oil with synethic oil are particularly useful. For example, blends of 5-25 weight percent hydrogenated α-decene trimer with 75-95 weight percent 150 SUS (100° F.) mineral oil results in an excellent lubricant. Likewise, blends of about 5-25 weight percent di-(2-ethylhexyl)adipate with mineral oil of proper viscosity results in a superior lubricating oil. Also blends of synthetic hydrocarbon oil with synthetic esters can be used. Blends of mineral oil with synthetic oil are especially useful when preparing low viscosity oil (e.g. SAE 5W 20) since they permit these low viscosities without contributing excessive volatility.

The more preferred lubricating oil composition includes zinc dihydrocarbyldithiophosphate (ZDDP) in combination with the present additives. Both zinc dialkyldithiophosphates and zinc dialkaryldithiophosphates as well as mixed alkyl-aryl ZDDP are useful. A typical alkyl-type ZDDP contains a mixture of isobutyl and isoamyl groups. Zinc di-(nonylphenyl)dithiophosphate is a typical aryl-type ZDDP. Good results are achieved using sufficient ZDDP to provide about 0.01-0.5 weight percent zinc. A preferred concentration supplies about 0.05-0.3 weight percent zinc.

Another additive used in the oil compositions are the alkaline earth metal petroleum sulfonates or alkaline earth metal alkaryl sulfonates. Examples of these are calcium petroleum sulfonates, magnesium petroleum sulfonates, barium alkaryl sulfonates, calcium alkaryl sulfonates or magnesium alkaryl sulfonates. Both the neutral and the overbased sulfonates having base numbers up to about 400 can be beneficially used. These are used in an amount to provide about 0.05-1.5 weight percent alkaline earth metal and more preferably about 0.1-1.0 weight percent. In a most preferred embodiment the lubricating oil composition contains a calcium petroleum sulfonate or alkaryl (e.g. alkylbenzene) sulfonate.

Viscosity index improvers can be included such as the polyalkylmethacrylate type or the ethylene-propylene copolymer type. Likewise, styrene-diene VI improvers or styrene-acrylate copolymers can be used. Alkaline earth metal salts of phosphosulfurized polyisobutylene are useful.

The crankcase oils can also contain other ashless dispersants such as the polyolefin-substituted succinamides and succinimides of ethylene polyamines such as tetraethylenepentamine. The polyolefin succinic substituent is preferably a polyisobutene group having a molecular weight of from about 800 to 5,000. Such ashless dispersants are more fully described in U.S. Pat. Nos. 3,171,892 and 3,219,666 incorporated herein by reference.

Another useful class of ashless dispersants are the polyolefin succinic esters of mono- and polyhydroxyl alcohols containing about 1 to about 40 carbon atoms. Such dispersants are described in U.S. Pat. Nos. 3,381,022 and 3,522,179.

Likewise, mixed ester/amides of polyolefin substituted succinic acid made using alkanols, amines and/or aminoalkanols represent a useful class of ashless dispersants.

The succinic amide, imide and or ester type ashless dispersants may be boronated by reaction with a boron compound such as boric acid. Likewise the succinic amide, imide, and/or ester may be oxyalkylated by reaction with an alkylene oxide such as ethylene oxide or propylene oxide.

Other useful ashless dispersants include the Mannich condensation products of polyolefin-substituted phenols, formaldehyde and polyethylene polyamine. Preferably, the polyolefin phenol is a polyisobutylene-substituted phenol in which the polyisobutylene group has a molecular weight of from about 800 to 5,000. The preferred polyethylene polyamine is tetraethylene pentamine. Such Mannich ashless dispersants are more fully described in U.S. Pat. Nos. 3,368,972; 3,413,347; 3,442,808; 3,448,047; 3,539,633; 3,591,598; 3,600,372; 3,634,515; 3,697,574; 3,703,536; 3,704,308; 3,725,480; 3,726,882; 3,736,357; 3,751,365; 3,756,953; 3,793,202; 3,798,165; 3,798,247 and 3,803,039.

The above Mannich dispersants can be reacted with boric acid to form boronated dispersants having improved corrosion properties.

Tests were conducted which demonstrate the excellent dispersant properties of the reaction products. The tests were industry-recognized ASTM Sequence VD tests. In these tests, a Ford Pinto engine is operated under carefully controlled conditions for a 192 hour period. At the end of this period, various parts of the engine are rated for cleanliness and freedom from varnish on a scale from 0 to 10 where 10 is clean.

The tests were conducted using a motor oil formulated for use in an engine crankcase containing conventional crankcase oil additives (viz, zinc dialkyldithiophosphate, overbased calcium alkylbenzene sulfonate, olefin copolymer VI improver, phenolic antioxidant, antirust additive and silicone antifoam agent) except that the dispersant usually used in such motor oils was replaced with the new dispersant of the present invention. Passing results require: average sludge 9.4, average varnish 6.6, piston varnish 6.7. Results obtained with the present additive were as follows:

| Additive | Conc. Wt. % | Avg. Sludge | Avg. Varnish | Piston Varnish |
|---|---|---|---|---|
| Example 1 | 4.25 | 9.49 | 6.88 | 7.39 |
| Example 2 | 4.25 | 9.69 | 6.38 | 7.02 |
| Example 3* | 5.0 | 8.88 | 6.09 | 7.45 |

*Contained a Mg phenate and overbased Mg sulfonate instead of overbased Ca sulfonate These results show that the product of Example 1 passed all three criteria. The Example 2 additive gave excellent results although it was a close fail on average varnish. A close fail result can usually be brought within the pass range by adjusting the concentration of the conventional additives or by using more of the new dispersant. The results suggest that the best additives will be made using an alkenyl succinic anhydride to amino pyrrolidone mole ratio of 1-2 to 1.0, probably closer to 1.25-2 to 1.0.

I claim:

1. A dispersant suitable for use in lubricating oil made by a process comprising reacting at 100°-300° C.

(a) an amino pyrrolidone intermediate made by reacting about 0.5-2.5 moles of butyrolactone with about 1 mole of an ethylene polyamine, at 100°-300° C.

(b) about 1-3 moles of an aliphatic hydrocarbon-substituted succinic anhydride, acid or lower alkyl ester thereof wherein said hydrocarbon substituent has a molecular weight of about 700-100,000, and (c) a boronating agent in an amount sufficient to impart about 0.01-1.5 weight percent boron into the final product.

2. A dispersant of claim 1 wherein said ethylene polyamine comprises mainly a mixture of diethylenetriamine, triethylenetetramine, and tetraethylenepentamine.

3. A dispersant of claim 1 wherein said hydrocarbon substituent is an olefin polymer substituent having a molecular weight of about 700-100,000.

4. A dispersant of claim 3 wherein said hydrocarbon substituent is a butene polymer substituent having a molecular weight of about 700-10,000.

5. A dispersant of claim 2 wherein said boronating agent is boric acid.

6. A dispersant of claim 5 wherein said hydrocarbon substituent is a butene polymer substituent having a molecular weight of about 700-10,000.

7. A dispersant of claim 6 wherein said amino pyrrolidone intermediate is made by reacting approximately equimolar amounts of said butyrolactone and said ethylene polyamine.

8. A dispersant of claim 7 wherein said butene polymer substituted succinic acid, anhydride or lower alkyl ester is used in an amount from about 1-3 moles per mole of said amino pyrrolidone intermediate.

9. A lubricating oil composition comprising a major amount of an oil of lubricating viscosity and a minor amount sufficient to improve dispersancy of a product of claim 1.

10. A composition of claim 9 wherein said ethylene polyamine used to make said product comprises mainly a mixture of diethylenetriamine, triethylenetetramine, and tetraethylenepentamine.

11. A composition of claim 9 wherein said hydrocarbon substituent of said succinic anhydride, acid or lower alkyl ester thereof is an olefin polymer substituent having a molecular weight of about 700-100,000.

12. A composition of claim 11 wherein said hydrocarbon substituent is a butene polymer substituent having a molecular weight of about 700-10,000.

13. A composition of claim 10 wherein said boronating agent is boric acid.

14. A composition of claim 13 wherein said hydrocarbon substituent of said succinic anhydride, acid or lower alkyl ester thereof is a butene polymer substituent having a molecular weight of about 700-10,000.

15. A composition of claim 14 wherein said amino pyrrolidone intermediate is made by reacting approximately equimolar amounts of said butyrolactone and said ethylene polyamine.

16. A composition of claim 15 wherein said butene polymer substituted succinic acid, anhydride or lower alkyl ester thereof is used in an amount from about 1-3 moles per mole of said amino pyrrolidone intermediate.

* * * * *